US006204463B1

(12) United States Patent
Stringos

(10) Patent No.: US 6,204,463 B1
(45) Date of Patent: Mar. 20, 2001

(54) SELF-ADJUSTING SWITCH MECHANISM WITH ANTI-ADJUSTMENT PROTECTION

(75) Inventor: Evan Stringos, G'Mangia (MT)

(73) Assignee: Methode Electronics Malta Ltd., Mriehel (MT)

( * ) Notice: Subject to any disclaimer, the term of this patent is extended or adjusted under 35 U.S.C. 154(b) by 0 days.

(21) Appl. No.: 09/593,578

(22) Filed: Jun. 14, 2000

(30) Foreign Application Priority Data

Dec. 21, 1999 (DE) ..... 199 61 599

(51) Int. Cl.[7] ..... H01H 3/16; H01H 9/02; H01H 13/20

(52) U.S. Cl. ..... 200/520; 200/296; 200/341

(58) Field of Search ..... 200/16 R, 16 C, 200/17 R, 520, 521, 523, 294, 296, 329, 341, 345

(56) References Cited

U.S. PATENT DOCUMENTS 5,389,756 * 2/1995 Micallef ..... 200/345
5,826,709 * 10/1998 Jacob ..... 200/345
5,853,084 * 12/1998 Carter et al. ..... 200/345
5,947,268 * 9/1999 Lange et al. ..... 200/345
5,960,940 * 10/1999 Elting et al. ..... 200/296

* cited by examiner

*Primary Examiner*—Michael Friedhofer
(74) *Attorney, Agent, or Firm*—Michael J. Striker

(57) ABSTRACT

A switch mountable in a feeding aperture in a support plate has an elongated housing having a base, a retention device for fixing the switch to the support plate, a switch plunger movable longitudinally against a spring action, a slider movable relative to the switch plunger and surrounding the switch plunger over a part of its length, radial vanes provided and guide grooves are guided in the guide grooves parallel to the longitudinal axis so as to move longitudinally up to opposite wall sections of the housing, limit stops for fixing the slider in an axial direction between the limit stops, notched tracks having locking teeth extending parallel to the longitudinal axis and provided on a shank of the plunger and inside the slider, which intermesh and fix the switch plunger to the slider in an axial direction when the switch plunger is turned with respect to the slider, the switch plunger with the housing being rotatable about the longitudinal axis with respect to the slider until a mutual engagement of the notched tracks takes place, and on further rotation the slider is released from engagement with the limit stops, and thus after adjustment of a length of the plunger, the slider is guided longitudinally together with the switch plunger in the guide grooves.

8 Claims, 3 Drawing Sheets

SELF-ADJUSTING SWITCH MECHANISM WITH ANTI-ADJUSTMENT PROTECTION

BACKGROUND OF THE INVENTION

The invention concerns a switch with devices for selfadjustment when the switch is mounted in a fitting aperture in the supporting in the support plate of a pedal box or similar.

When fitting switches, which are used for checking the positions of brake or clutch pedals as well as for use as brake-light switches or for other purposes problems frequently occur with the adjustment of the switches for a functionally correct method of operation. This applies in particular to accurate adjustment of the switch positions and the contact travel of such switches, in order to allow for the tolerances involved in the manufacture of the pedal box. This has led to the use of push-switches with adjustable lengths, but these frequently fail to satisfy the specified requirements for switching accuracy. Furthermore, the installation and adjustment of such switches is time consuming and thus expensive.

Self-adjusting switches can also be prone to the following problems:

Accidental or unintentional maladjustment during shipment of parts, vehicle assembly or serving;

Fatigue or gradual slackening of the adjustment system;

Maladjustment of the switch due to overtravel of the pedal.

This has led to various solutions in the design of quick-fit self-adjusting switches with adjustment protection, but which are frequently unsatisfactory.

The invention is based on the problem of creating a switch of the type described at the outset with devices for self-adjustment during fitting of the switch and with a simple construction, so that it can be mounted on the vehicle in a single operation, in which it is not only fixed in the fitting position but simultaneously also adjusted for functionally correct operation.

This problem is solved with a switch with the following characteristics:

a) the switch has an elongated switch housing with a base and a retention device for fixing the switch to the support plate, b) there is a switch plunger in the longitudinal axis of the switch housing which can move longitudinally against the action of a spring, c) the switch has a slider which can move with respect to the switch plunger and surrounds the plunger over part of its length, and is guided with radial vanes in guide grooves parallel to the axis, so that it can move longitudinally up to opposite-lying wall sections of the switch housing, d) alongside the guide grooves for the slider, there are limit stops arranged in staggered formation in the circumferential direction of the switch housing, between which the slider can be fixed in the axial direction, e) furthermore, the plunger shank and the inside of the slider are provided with notched tracks with rows of locking teeth parallel to the axis, which intermesh like a comb and fix the switch plunger to the slider in the axial direction when the switch plunger is turned with respect to the slider, f) the switch plunger together with the switch housing can be rotated about its longitudinal axis with respect to the slider until mutual engagement of the notched tracks take place, g) on further rotation of the switch plunger with respect to the slider about the longitudinal axis after engagement of the notched tracks, the slider is released from engagement with the limit stops on the switch housing and the base, and thus after adjustment of the length of the plunger shank the slider is guided longitudinally together with the switch plunger in the guide grooves on the switch housing.

The invention has the advantage that such switches cannot be accidentally or unintentionally maladjusted before they are fitted. The situation is rather that when the switches, with the moving parts of the switches in the initial state as supplied by the manufacturer, are mounted on the vehicle, they are simply inserted in an fitting aperture provided in a suitable support, for example in a pedal box support, in which simultaneously with the fitting procedure the movable switch parts are also automatically adjusted, so that the switch adjustment is already complete after it is fitted.

The decisive factor in this simple fitting procedure with automatic adjustment of the switch during the fitting procedure is that the switch has a slider which moves with respect to the switch plunger; and the slider has radial vanes with which it is moved longitudinally in guide grooves parallel to the axis up to opposite-lying wall sections of the switch housing.

Alongside the guide grooves for the slider, the switch housing and base contains limit stops between which the slider, in the condition as supplied, that is before fitting, is fixed in the axial direction. This slider can be moved longitudinally along a guide piece, which can rotate about the longitudinal axis of the switch housing. The plunger shank and the inside of the slider are also provided with notched tacks with rows of locking teeth arranged parallel to the axis, which intermesh like a comb and fix the switch plunger to the slider in the axial direction when the switch plunger is turned with respect to the slider. The switch plunger is moreover designed so that it cannot rotate in the switch housing, and can thus be rotated about its longitudinal axis together with the switch housing with respect to the slider until the notched tracks engage.

With the switch in the condition as supplied, the guide piece for. the slider is provided at the end with locking cams situated beneath hook-shaped retention lugs on the switch housing. The switch with these retention lugs can be inserted from underneath into a profiled fitting aperture in the pedal box or similar, and locked by simply rotating it about its longitudinal axis in the aperture.

When it is fitted into the fitting aperture, the plunger shank pushes against the flag of a brake or clutch pedal and is thus pressed inwards against the pressure of a return spring into the switch housing up to its adjustment position. When the switch is then rotated about its longitudinal axis, the locking cams held fixed in the appropriately contoured aperture in the support plate, lock the guide piece with the slider against rotation, while the switch housing together with the switch plunger can be turned through an angle of approximately 45° in order to secure the switch in the fitting aperture. Turning the switch housing with the plunger causes the notched tracks on the plunger shank and on the inner circumference of the slider to engage, thereby locking the switch plunger together with the slider in the adjusted position. Further rotation of the housing and the switch plunger together with respect to the slider moreover unlocks the latter at the axial limit stops on the switch housing, allowing it to move in the guide grooves in the switch housing parallel to the axis against the pressure spring for the switch plunger and between switch positions ON and OFF.

This results in the following advantages:

The plunger length can be set to the length required simply by inserting the switch into the aperture in the support plate and then rotating it.

As soon as the switch is fixed in the fitting position, its adjustment cannot be changed.

The switch tolerates the pedal travel being exceeded.

fitting is carried out in a single operation and the fitter does not need to move the pedal to and fro for adjustment purposes.

when the switch is removed from the pedal box, the switch is automatically reset to its original length and is ready for further use.

The switch cannot be adjusted or maladjusted during shipment.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 the switch on insertion into a profiled fitting aperture in a support plate on a pedal box or similar;

FIG. 5 a perspective view of the switch partly in sections in the installed position in the fitting aperture in the support plate of a pedal box support or similar;

DESCRIPTION OF PREFERRED EMBODIMENTS

Figure 7:
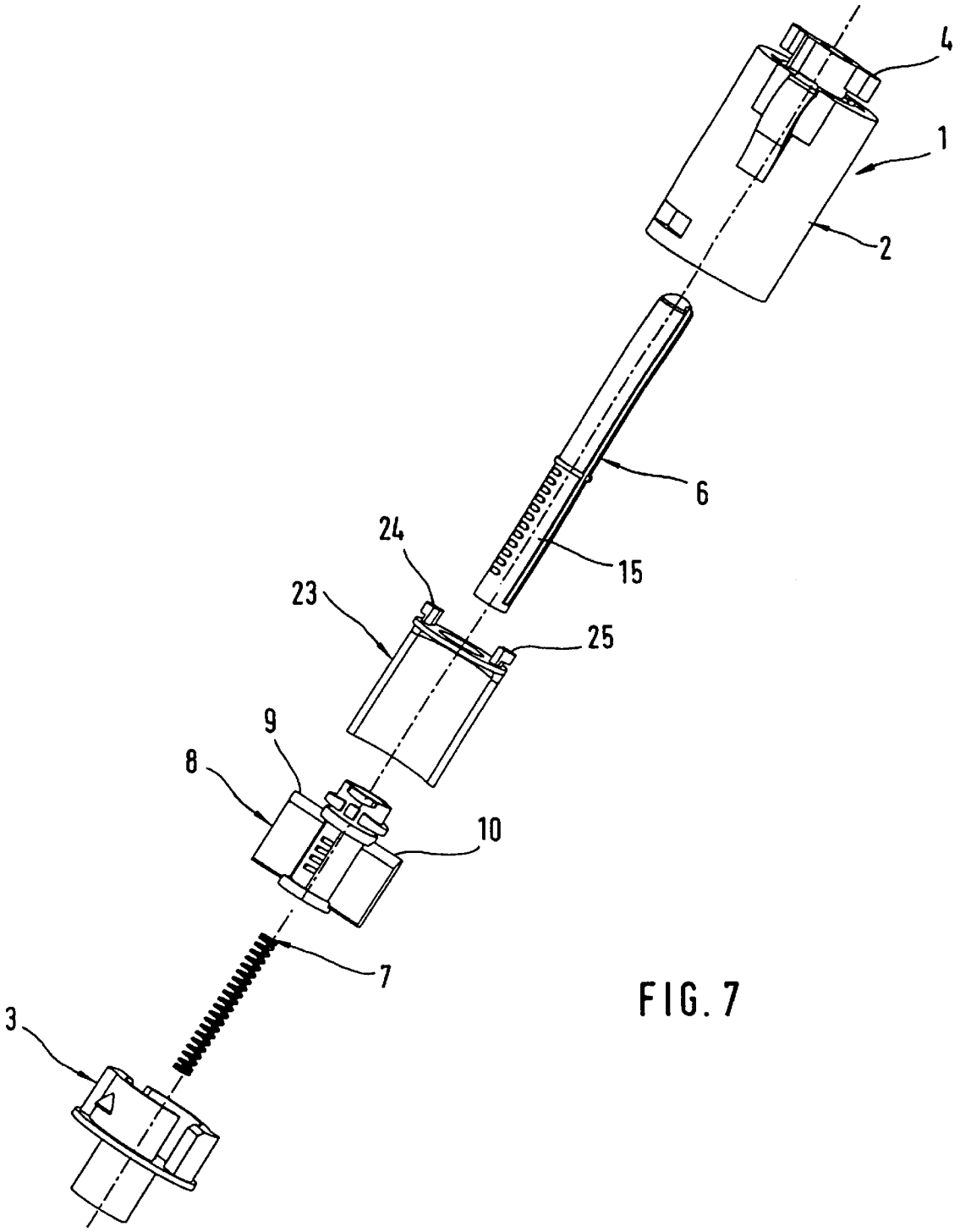
FIG. 7 the essential individual parts of the switch is an exploded illustration.

The switch 1 shown in FIGS. 1 to 7 inclusively has elongated switch housing 2 with a base 3 and a retention device 4 to fix the switch 1 to a support plate 5. A switch plunger 6 can be moved longitudinally in the longitudinal axis of the switch housing 2 against the action of a pressure spring 7 (FIG. 7). The switch 1 has a slider 8 which moves with respect to the switch plunger 6 and surrounds the plunger 6 over part of its length, and with radial vanes 9, 10 can be moved longitudinally in guide grooves 11, 12 parallel to the axis (FIG. 5) up to opposite-lying wall sections of the switch housing 2. Alongside the guide grooves 11,12 for the slider 8, there are limit stops 13, 14 arranged in staggered formation (FIGS. 1 and 5) in the circumferential direction of the switch housing 2 and base 3 between which the slider 8 can be fixed in the axial direction. Furthermore, the plunger shank 15 and the inside of the slider are provided with notched tracks 16, 17 with rows of locking teeth 16*a*, 17*a* parallel to the axis, which intermesh like a comb and fix the switch plunger to the slider 8 in the axial direction when the switch plunger 6 is turned with respect to the slider.

The switch plunger 6 together with the switch housing 2 can be rotated about its longitudinal axis with respect to the slider 8 until mutual engagement of the notched tracks 16, 17 takes place. When the switch plunger 6 and switch housing 2 are rotated further about their common longitudinal axis 18 (FIG. 5) after engagement of the notched tracks 16,17, the slider 8 is released from engagement with the limit stop 13, 14 on the switch housing 2 and base 3, and can thus, after adjustment of the length of the plunger shank 15, move longitudinally together with the switch plunger 6 in the guide grooves 11, 12 in the switch housing 2 between two switch positions ON and OFF.

At the end at which it is secured, the switch housing 2 has a retention device 4 surrounding the plunger shank 15 in which this retention device 4 is permanently attached to the switch housing 2 and is provided with hook-shaped retention lugs 20,2 21 at a distance from the top end of the switch housing 2 protruding radially outwards with respect to a substantially cylindrical section 19. These retention lugs 20, 21 are identical with the shape of a fixing aperture 22 with radial cutouts 22*a*, 22*b* in the support plate 5 of a pedal box or similar, so that when the switch 1 is fitted to the support plate 5, the retention lugs 20, 21 pass through the fixing aperture 22 with the radial cutouts 22*a*, 22*b*, and after rotation of the switch housing 2 about its longitudinal axis 18, secure the switch housing 2 to the support plate 5 with the hook-shaped retention lugs 20, 21. This is shown separately in FIGS. 1 to 5 inclusively.

Figure 1:
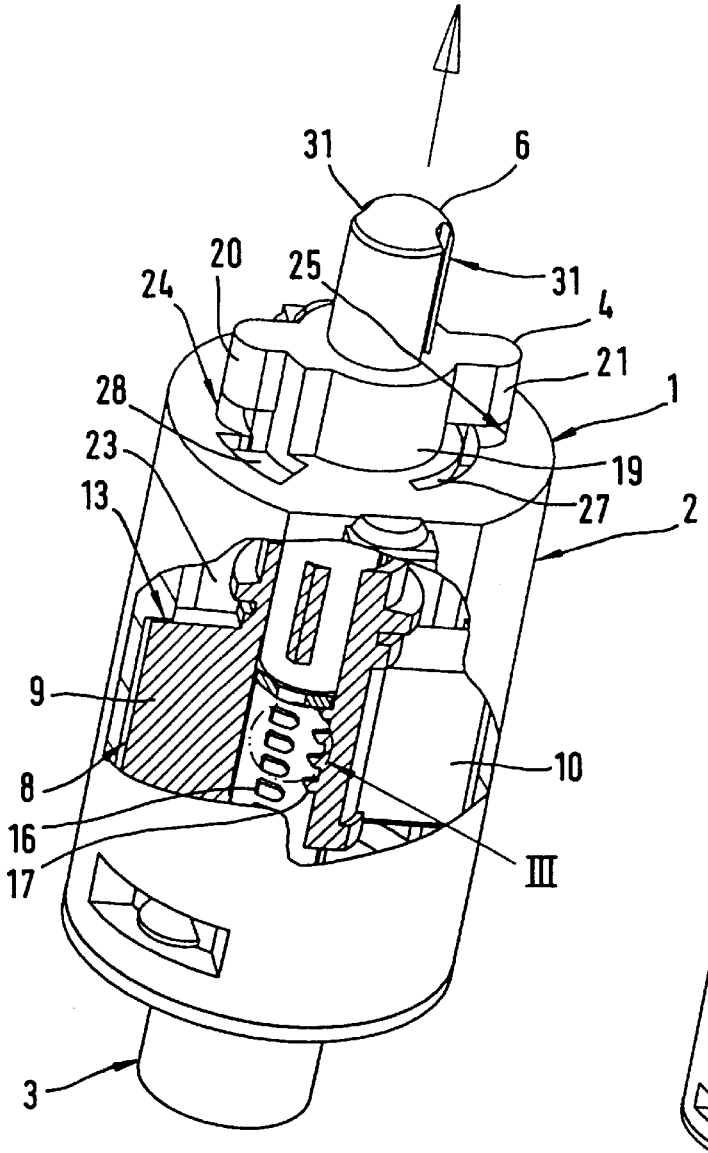
FIG. 1 a perspective view of a plunger switch shown partly in sections.
Figure 5:
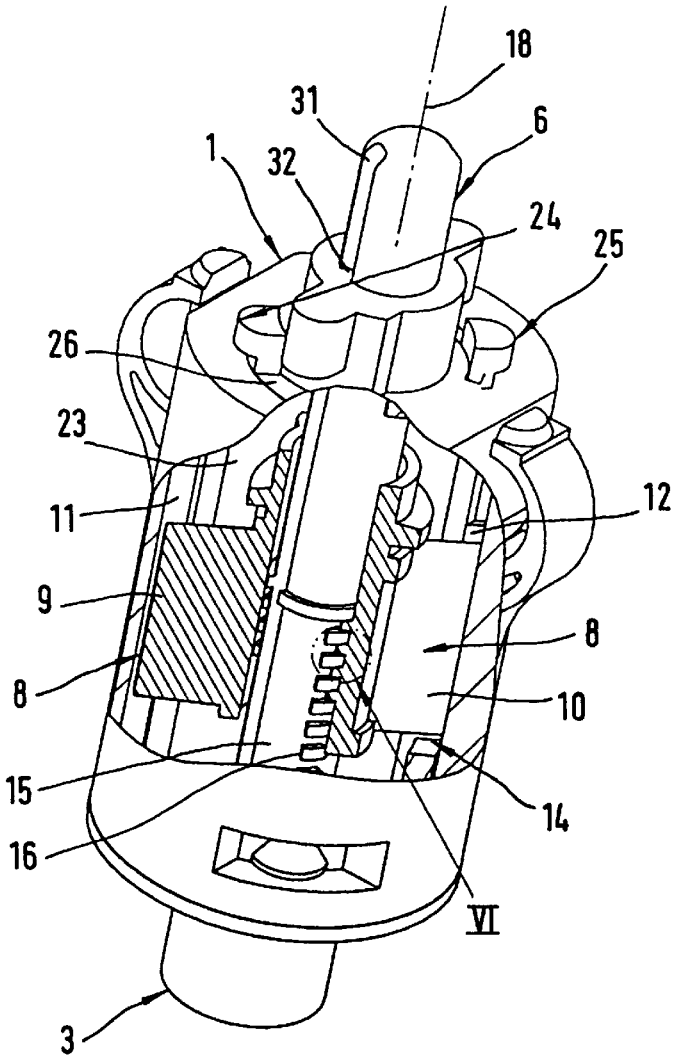

As can be seen in FIGS. 1, 5, and 7 the slider 8 in the switch housing 2 can be moved along a guide piece 23 longitudinally with respect to the switch housing 2 about whose longitudinal axis 18 the guide piece 23 can be rotated up to the limit stops. The end of this guide piece 23 is constructed with hook-shaped locking cams 24, 25 identical in shape with the shape of the retention lugs 20, 21 on the switch housing 2, and to which the guide piece 23 is secured in circular arc shaped slots 26, 27 (FIGS. 1 and 5) at the top end of the switch housing 2 about whose longitudinal axis 18 can be rotated.

For assembly of the switch 1, the front end of the switch housing 2 is provided with apertures 28 for the locking cams 24, 25 of the guide piece 23 under and directly adjacent to the retention lugs 20, 21, and displaced with respect to the latter in the circumferential direction, so that the guide piece 23 with the locking cams 24, 25 passes through the apertures 28 and can be secured by anti-clockwise rotation along the circular arc shaped slots 26, 27 in a coincident position in axial extension of the retention lugs 20,2 1 of the retention device 4 of the switch housing 2.

Figure 2:
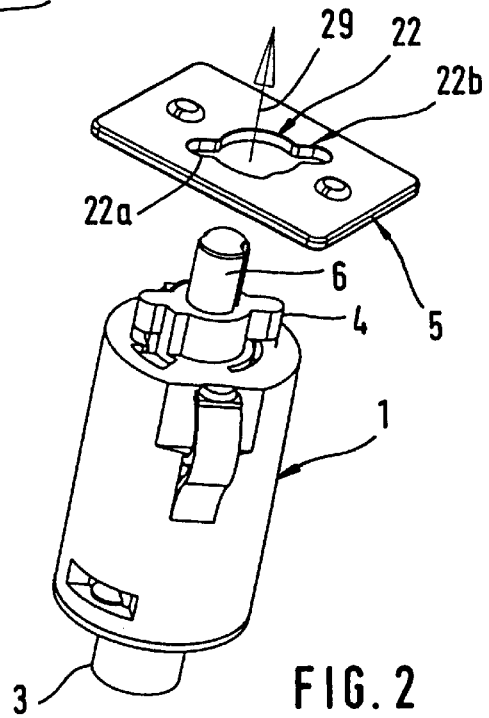
Figure 3:
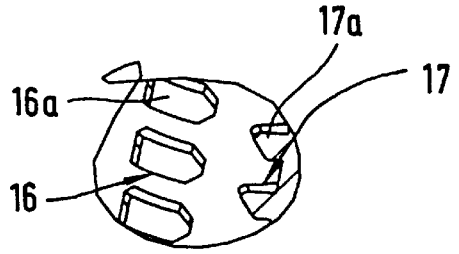
FIG. 3 an enlarged partial illustration of notched tracks on the plunger shank and on the slider of the switch according to Detail III of FIG. 1.

This can be seen in FIGS. 1 and 2. The retention lugs 20, 21 on the switch housing 2 and the locking cams 24, 25 on the guide piece 23 for the slider 8 are in alignment with one another, so that the switch 1 can be inserted from underneath in the direction of the arrow 29 in FIG. 2 into the correspondingly profiled fitting or fixing aperture 22 in the support plate 5. The switch 1 is then turned in the direction of the arrow 30 in FIG. 4 through an angle of approximately 45° and thus secured in the fitting aperture 22. The locking cams 24, 25 on the guide piece 23 are secured in the radial cutouts 22*a*,22*b* of the fitting aperture 22, while the outer-lying hook-shaped retention lugs 20, 21 are turned with the switch housing 2 in the direction of the arrow 30 and overlap the edge of the fitting aperture 22 in the support plate 5 and thus secure the switch 1 in the pedal box.

Figure 4:
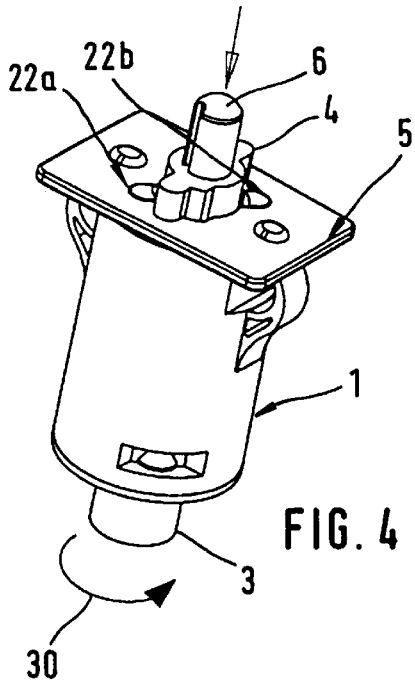
FIG. 4 the switch in this installed position on the support plate.
Figure 6:
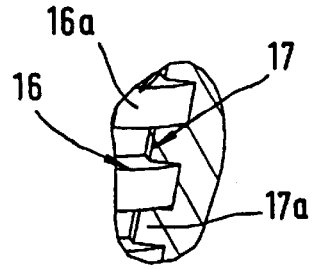
FIG. 6 an enlarged partial illustration of a detailed VI of FIG. 5.

As can also be seen in FIGS. 1, 4 and 5, the plunger shank in the switch housing 2 is secured against turning. For this purpose, the plunger shank 15 is provided with parallel longitudinal grooves 31 to engage with radial, inwardly-directed locating studs 32 in the bush for the plunger shank 15 at the front of the switch housing 2 (FIGS. 1 and 5).

For perfect mutual engagement when the plunger shank 15 is turned with respect to the slider 8, the comb-like interlocking teeth 16*a* on the plunger shank 15 and on the slider 8 (FIG. 3) have wedge-shaped chamfering at their ends, these ends being directed towards each other.

When the switch 1 is in the condition as delivered as in FIG. 1, the switch plunger 6 can move freely, because the locking teeth 16*a* of plunger 6 are not engaged with the locking teeth 17*a* of the slider 8 or slide piece. The slider 8 is locked in the position in FIG. 1 in the longitudinal direction of the switch housing 2 by the internal limit stops 13, 14 on the housing 2 and on the base 3.

When the switch 1 is inserted in the fitting aperture 22 in the support plate 5 of the pedal box, the switch plunger 6 is pressed against the pedal above it and set to the desired length (see FIGS. 1 and 2), in which the force needed to actuate the switch I is substantially less than the force needed to press down the pedal.

When the switch housing 2 is secured and locked in the support plate 5 by turning it in the direction of the arrow 30 in FIG. 4, the guide piece 23 is prevented from turning inside the switch housing 2 by the profile of the fitting aperture 22 in the support plate 5 of the pedal box. This occurs, since the locking cams 24,2 5 on the guide piece 23 are secured in the radial cutouts 22*a*,22*b* of the fitting aperture 22 of the support plate 5. The guide piece 23 also prevents the slider 8 from turning.

When the switch 1 is turned with the switch plunger 6, the locking teeth 16*a* of the plunger thus engage with the locking teeth 17*a* in the slider 8. At the same time, the slider 8 disengages from the internal limit stops 13, 14, so that the switch 1 is ready to operate when the pedal is depressed. This can be seen in FIGS. 4 and 5.

It will be understood that each of the elements described above, or two or more together, may also find a useful application in other types of constructions differing from the types described above.

While the invention has been illustrated and described as embodied in self-adjusting switch mechanism with anti-adjustment protection, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A switch mountable in a feeding aperture in a support plate, the switch comprising an elongated housing having a base; a retention device for fixing the switch to the support plate; a switch plunger extending along a longitudinal axis of said housing and movable longitudinally against a spring action; a slider movable relative to said switch plunger and surrounding said switch plunger over a part of its length; means for guiding said slider and including radial vanes provided on said slider and guide grooves provided in said housing so that said radial vanes of said slider are guided in said guide grooves of said housing parallel to said longitudinal axis so as to move longitudinally up to opposite wall sections of said housing; limit stops arranged along side said guide grooves in staggered formation in a circumferential direction of said housing so that said slider is fixable in an axial direction between said limit stops; notched tracks having rows of locking teeth extending parallel to said longitudinal axis and provided on a shank of said plunger and inside said slider, which intermesh like a comb and fix said switch plunger to said slider in an axial direction when said switch plunger is turned with respect to said slider, said switch plunger together with said housing being rotatable about said longitudinal axis with respect to said slider until a mutual engagement of said notched tracks takes place, and on further rotation of said switch plunger with respect to said slider around said longitudinal axis after engagement of said notch tracks, said slider is released from engagement with said limit stops on said housing and said base, and thus after adjustment of the length of said plunger, said slider is guided longitudinally together with said switch plunger in said guide grooves of said housing.

2. A switch as defined in claim 1, wherein said retention device has a cylindrical section surrounding said plunger shank and hook-shaped retention lugs arranged at a distance from a top end of said housing and protruding radially outwards from said cylindrical section, said hook shaped retention legs having contours corresponding to a shape of a fixing aperture with radial cutouts in the support plate, so that when the switch is fitted to the support plate, said retention lugs pass through the fixing aperture with the radial cutouts, and after rotation of the housing about said longitudinal axis, secure the housing to the support plate with said hook-shaped retention lugs.

3. A switch as defined in claim 2; and further comprising a guide piece along which said slider is movable longitudinally with respect to said housing, said guide piece being rotatable about said longitudinal axis of said housing up to said limit stops.

4. A switch as defined in claim 3, wherein said guide piece has an end provided with hook-shaped locking cams having a shape identical to that of said retention lugs, said guide piece being secured by said hook4 shaped locking cams in circular arc shaped slots at the top end of said housing and is rotatable about said longitudinal axis of said housing.

5. A switch as defined in claim 4, wherein said housing has a front end provided with apertures for said locking cams of said guide piece under said retention lugs, so that said guide piece with said locking cams passes through said apertures and is securable by rotation along said circular arc shaped slots in a coincident position in an axial extension of said retention lugs.

6. A switch as defined in claim 5, wherein said locking cams on said guide piece are securable in the radial cutouts of the fixing aperture of the support plate, said housing being securable and lockable in the support plate by turning of said housing, so that said guide piece is prevented from turning inside said housing and said guide piece also prevents said slider from turning.

7. A switch as defined in claim 6, wherein said housing has the front end provided with radially inwardly directed locating studs, said plunger shank being provided with parallel longitudinal grooves in which said studs are engaged.

8. A switch as defined in claim 1, wherein the shank of said plunger and said slider have the comb-like interlocking teeth provided with a wedge-shaped chamfering at ends of said teeth, said ends being directed toward each other.

* * * * *